US011085649B2

(12) United States Patent
Sperka et al.

(10) Patent No.: US 11,085,649 B2
(45) Date of Patent: Aug. 10, 2021

(54) EXHAUST HOOD WITH FORCED AIR INJECTION

(71) Applicant: Franke Technology and Trademark Ltd, Hergiswil (CH)

(72) Inventors: Michael Sperka, Murg (DE); Wolfgang Kunze, Herrischried (DE); Ireneusz Czapp, Reda (PL); Mark Ashley, Section, AL (US)

(73) Assignee: Franke Technology and Trademark Ltd, Hergiswil (CH)

( * ) Notice: Subject to any disclaimer, the term of this patent is extended or adjusted under 35 U.S.C. 154(b) by 22 days.

(21) Appl. No.: 16/744,713

(22) Filed: Jan. 16, 2020

(65) Prior Publication Data

US 2020/0149747 A1 May 14, 2020

Related U.S. Application Data

(63) Continuation of application No. 15/850,220, filed on Dec. 21, 2017, now Pat. No. 10,578,315.

(51) Int. Cl.
*F24C 15/20* (2006.01)

(52) U.S. Cl.
CPC ..... *F24C 15/2042* (2013.01); *F24C 15/2028* (2013.01)

(58) Field of Classification Search
CPC ... B08B 15/023; A47F 3/0447; F24C 15/2042
See application file for complete search history.

(56) References Cited

U.S. PATENT DOCUMENTS

| | | | |
|---|---|---|---|
| 4,896,657 | A | 1/1990 | Glassman |
| 4,944,285 | A | 7/1990 | Glassman |
| 6,041,774 | A | 3/2000 | Ward et al. |
| 6,851,421 | B2 | 2/2005 | Livchak et al. |
| 2011/0094497 | A1 | 4/2011 | Schrock et al. |
| 2016/0161129 | A1 | 6/2016 | Huang |

FOREIGN PATENT DOCUMENTS

| | | |
|---|---|---|
| CN | 102183056 | 9/2011 |
| JP | S63123939 | 5/1988 |
| WO | 2013006789 | 1/2013 |
| WO | 2014142767 | 9/2014 |
| WO | 2015057072 | 4/2015 |

*Primary Examiner* — Jason Lau
(74) *Attorney, Agent, or Firm* — Volpe Koenig

(57) ABSTRACT

An exhaust hood includes a housing, which is open towards a bottom face to capture cooking by-products from a cooking appliance positioned below the exhaust hood. The housing has a first wall and a second wall opposite to the first wall. The second wall is at least partly inclined inwardly from the bottom face towards a top face of the housing and has an exhaust vent to extract cooking by-products captured by the housing. The exhaust hood has a fresh air fan and the first wall forms a first duct which has openings located in a row along a lower edge of the first wall adjacent to the bottom face and oriented inside the housing. A side wall extension extends from one side wall and forms a lateral skirt that defines a pass-through window having vertically and horizontally extending faces. The side wall extension forms a side wall duct with openings along the vertically and horizontally extending faces that eject vertical and horizontal air streams orthogonal to one another that coalesce to form a vortex which limit cooking by-products from passing through the pass-through window.

12 Claims, 6 Drawing Sheets

EXHAUST HOOD WITH FORCED AIR INJECTION

CROSS-REFERENCE TO RELATED APPLICATIONS

This application is a continuation of U.S. application Ser. No. 15/850,220, filed Dec. 21, 2017, which is incorporated by reference as if fully set forth.

FIELD OF THE INVENTION

The present invention relates to the field professional kitchen devices and more particular to an exhaust hood for removing cooking by-products from a kitchen environment.

BACKGROUND

An exhaust hood is a device including a mechanical fan that is installed above the stove or cooktop in the kitchen. It removes airborne grease, combustion products, fumes, smoke, odors, and steam from the air by evacuation of the air. In most exhaust hoods, a filtration system removes grease and other particles. Although many exhaust hoods exhaust air to the outside, some recirculate the air to the kitchen. In a recirculating system, filters may be used to remove odors in addition to the grease. Commercial exhaust hoods may also be combined with a fresh air fan that draws in exterior air, circulating it with the cooking fumes, which are then drawn out by the hood.

U.S. Pat. No. 6,851,421 B2 describes an exhaust hood, which captures and contains a thermal plume by defining a vertical curtain jet. In one embodiment, vertical and horizontal jets can be combined to augment capture and containment. The horizontal jet pushes the plume toward the exhaust vent at the side of the hood and creates a negative pressure field around the forward edge of the hood which helps containment. The hood uses air nozzles in the form of small round holes positioned along the front of the exhaust hood. The nozzles are spaced apart from each other such that they form individual jets which combine into a curtain jet. However, on the one hand, the vertical air curtain may be efficient only for certain hood geometries and proves less efficient for others; on the other hand, the vertical air jets can be annoying for kitchen personnel who have to work below the hood all day.

SUMMARY

Therefore, it is an object of the present invention to improve the efficiency and performance of an exhaust hood in terms of capturing and removing cooking by-products and effluents such as airborne grease, combustion products, fumes, smoke, odors, and steam without the need of vertical air jets.

These and other objects that appear below are achieved by an exhaust hood with a housing, which is open towards a bottom face to capture cooking by-products from a cooking appliance positioned below said exhaust hood. The housing has at least a first wall being either a front wall or a rear wall of said housing and a second wall opposite to the first wall. The second wall is at least partly inclined inwardly from the bottom face towards a top face of the housing and has an exhaust vent that communicates with an exhaust fan to extract cooking by-products captured by the housing. The exhaust hood has a fresh air fan and the first wall is shaped to form a first duct which has a number of openings located in a row along a lower edge of the first wall adjacent to the bottom face and oriented to the inside of said housing. The first duct is in communication with the fresh air fan to inject air streams through the openings into the housing in a direction substantially parallel to the bottom face. This creates a vertical flat air stream directed from the first wall towards the second wall. According to one aspect, the openings are in the form of substantially rectangular slots, the long edges of which are oriented in parallel to said bottom face.

According to another aspect of the invention, the exhaust hood has a baffle sheet located at the inside of the first wall above the row of openings, which extends into the housing substantially parallel to the bottom face.

According to yet another aspect, the exhaust hood has a side wall and side wall extension. The side wall extension extends in a direction perpendicular to the bottom face below the housing to form a lateral skirt. The skirt has towards its bottom end a pass-through window forming a passage way for handling food products below the exhaust hood. The side wall extension is shaped to form a side wall duct with openings along a narrow side adjacent to the pass-through window facing downwardly and towards a front of the kitchen hood. The side wall duct is in communication with a fresh air fan to eject vertical and horizontal air streams through the openings, which coalesce to form a vortex that prevents cooking by-products from passing through the pass-through window.

The fresh air fan forces air through the rectangular slots on the inside front and, preferably, also on the sides of the exhaust hood. A close spacing of the rectangular slots creates a horizontal "knife" of air. The baffle sheet above the slots helps create a flat horizontal air stream. The forced air pushes rising smoke and other cooking by-products into the hood and towards the exhaust vent. This aids the ability of the hood to capture smoke at a lower exhaust air flow volume.

The fresh air fan can be arranged to draw air from the ceiling space above the hood, thus having no effect on the kitchen air as would be the case if fresh air was drawn from outside of the kitchen.

Further advantageous aspects are described by the dependent claims. In one aspect, a free end of the baffle sheet is angled by a flat angle downwardly towards the bottom face, preferably by approximately 10 degrees. Additionally or alternatively, a further, second baffle sheet can be provided which extends into the first duct in the direction opposite to the elongation of the first baffle sheet. This second baffle sheet can be angled upwardly at its free end such that it extends inside the duct substantially parallel to the first wall. This geometry improves the creation of the "air knife" stream.

According to another aspect, the openings or slots may have a ratio between their short and long edges of at least 1:10, preferably of at least 1:15. The spacing between neighbored openings can correspond to the dimension of the short edges.

In one embodiment, the first wall is designed to contain an inner and an outer sheet, which are connected to enclose a cavity with substantially trapezoidal cross section that serves as the first duct. The inner sheet can be at least partly inclined inwardly from the bottom face towards a top face of the housing.

According to yet another aspect, the air volume of the injected air streams corresponds to about 5% to 25%, preferably to 8% to 15% of the air volume extracted through said exhaust vent by said exhaust fan.

According to yet another aspect, the housing can have side walls, which are at least partly shaped to form second ducts, each having a number of openings located in a row along a lower edge of the side walls adjacent to said bottom face and oriented to the inside of the housing. The second ducts are in communication with the first duct to inject air streams through their openings into the housing in a direction substantially parallel to the bottom face.

In an embodiment, the second ducts have a substantially triangular shape decreasing in cross section from the first wall towards the second wall. Third and fourth baffle sheets can be provided at the side walls and inside their ducts, which correspond in shape and function to the first and second baffle sheets.

BRIEF DESCRIPTION OF THE DRAWINGS

Further advantages and characteristics of the invention will become apparent by the below description of embodiments making reference to the accompanying drawings, in which.

DETAILED DESCRIPTION OF THE PREFERRED EMBODIMENTS

Figure 1:
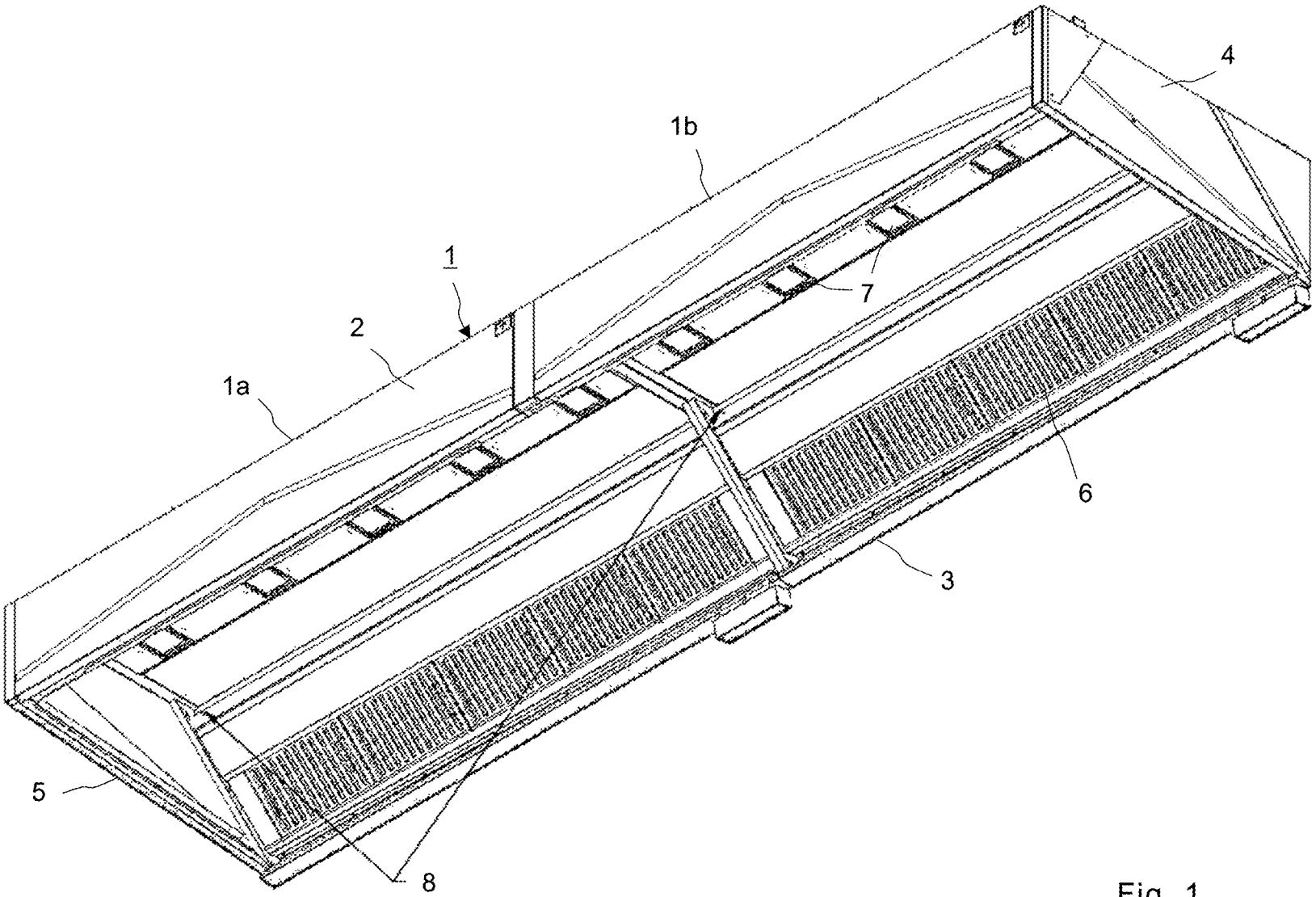
FIG. 1 shows a three-dimensional representation of a exhaust hood from the font and bottom side.
Figure 2:
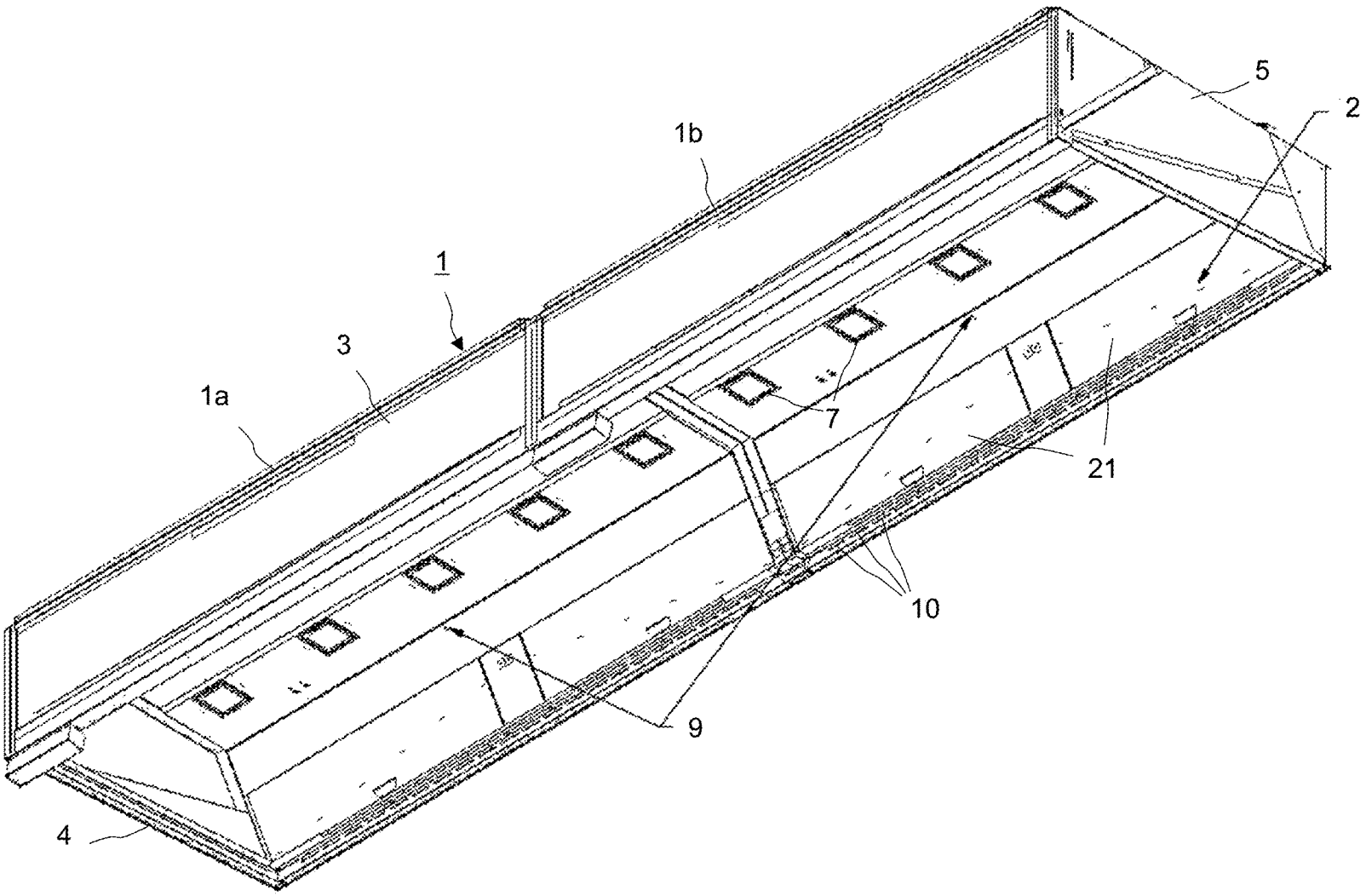
FIG. 2 shows the exhaust hood of FIG. 1 looking from the back side.

A canopy-style exhaust hood 1 is shown in FIGS. 1 and 2. The exhaust hood 1 has a housing or canopy with a front wall 2, a rear wall 3 and two side walls 4, 5. The housing is open at its bottom face to capture cooking by-products from a cooking appliance positioned below the hood 1. The rear wall 3 in inclined inwardly and has an exhaust vent 6 with grease filters for exhausted air. Light sources 7 are located at the top face of hood and pressure sensors 8, 9 are provided at measurement points near the front wall and the rear wall for measuring exhaust air and fresh air pressure, respectively.

The rear wall 3 with the exhaust vent 6 forms an exhaust plenum and is connected to an exhaust fan, which can be either internal to the hood 1 or external to it, e.g. roof mounted.

In the illustrated embodiment, the exhaust hood is of modular design and can be split in the middle into two parts 1*a*, 1*b* for simplified transport and installation. Moreover, the side walls 4, 5 can be removed and the hood expanded with further middle parts.

As shown in FIG. 2, the front wall has a number of openings in the form of rectangular slots 10 which are located in a row along the lower edge of the hood and are oriented to the inside of said housing such that their long edges are in parallel to the bottom face of the hood 1. The slots 10 serve as air inlets for injection of fresh air drawn by a fresh air fan, which is located at the top of the hood 1.

The front wall 2 is shaped to form an air duct 20 of triangular cross section. The fresh air fan sits at the inlet of this front wall air duct and draws air from the ceiling space above the hood into the duct 20 and injects the air in the form of flat air streams through the slots 10 into the housing in a direction substantially parallel to its bottom face. The forced air injection creates a flat air stream that is directed from the front wall 2 towards the rear wall 3 and the exhaust vent 6. The inner wall panels 21 are removable for cleaning purposes. Alternatively, the fresh air fan can also be attached to an outside vent thus pulling air from outside of the building or connected to a duct on the kitchen's HVAC system, i.e. the overall building heating, ventilating and air-conditioning (HVAC) system of the kitchen.

Figure 3:
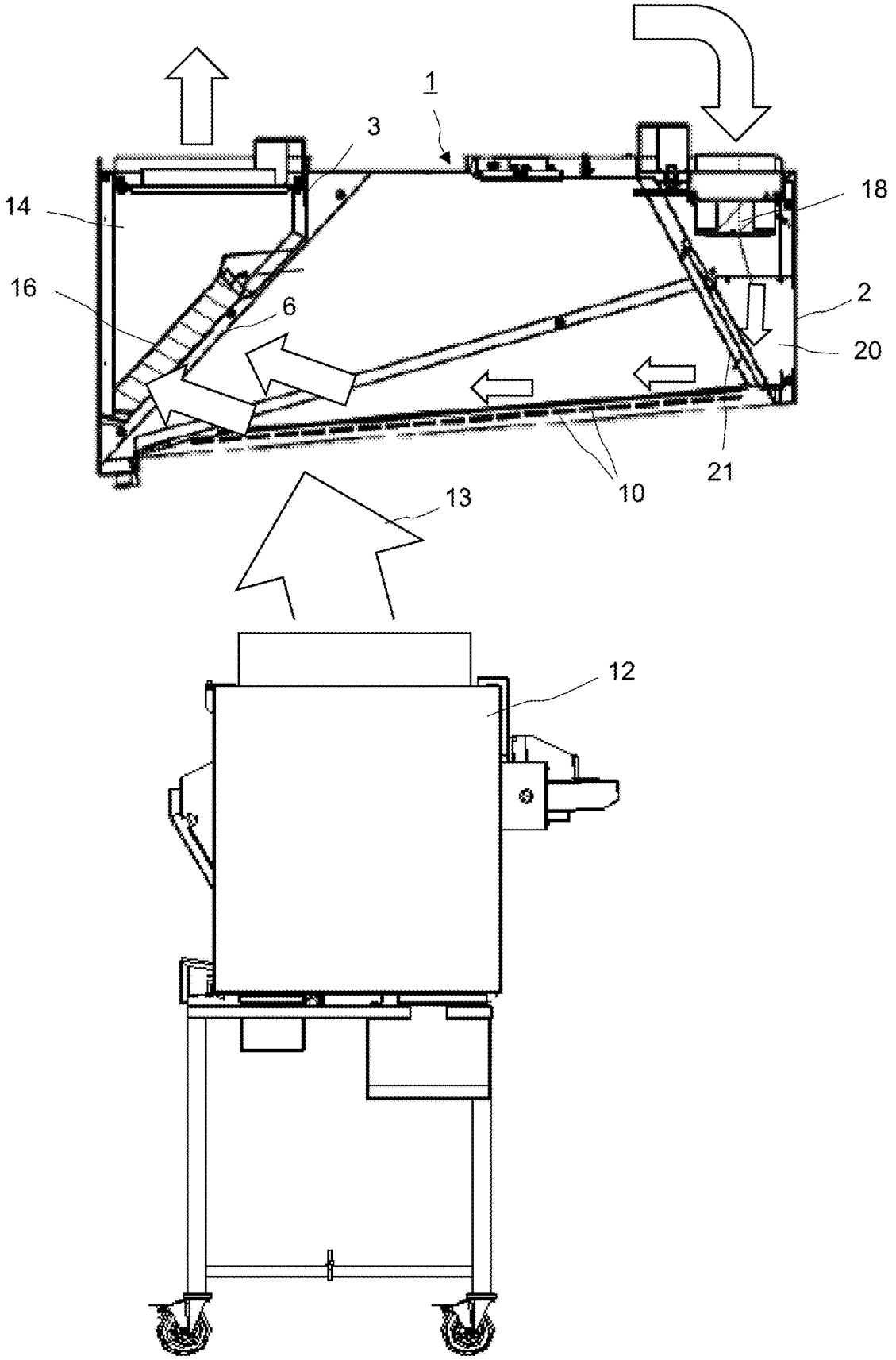
FIG. 3 shows a cross section of the hood in transverse direction and the flow of air and effluents from a kitchen appliance positioned below the hood.

FIG. 3 shows a kitchen appliance 12 such as a deep fryer positioned below the exhaust hood 1. Fumes, steam and other byproducts 13 from the deep fryer 12 rise up and are captured by the housing of the exhaust hood 1. An external exhaust fan, which is connected to the exhaust plenum 14 of the hood 1, extracts air from the hood and creates a negative pressure at the rear end of the hood 1. Air and cooking by-products are drawn through the exhaust vent 6 and grease filter 16 into the exhaust plenum 14 and from there out of the kitchen space.

A smaller fresh air fan draws air from above the exhaust hood 1 and forces the air through the slots 10 around the internal perimeter of the hood 1. The fresh air 19 thus injected pushes the smoke and other by-products 13 from the appliances 12 towards the exhaust vent 6 and into hood filters 16.

Figure 4:
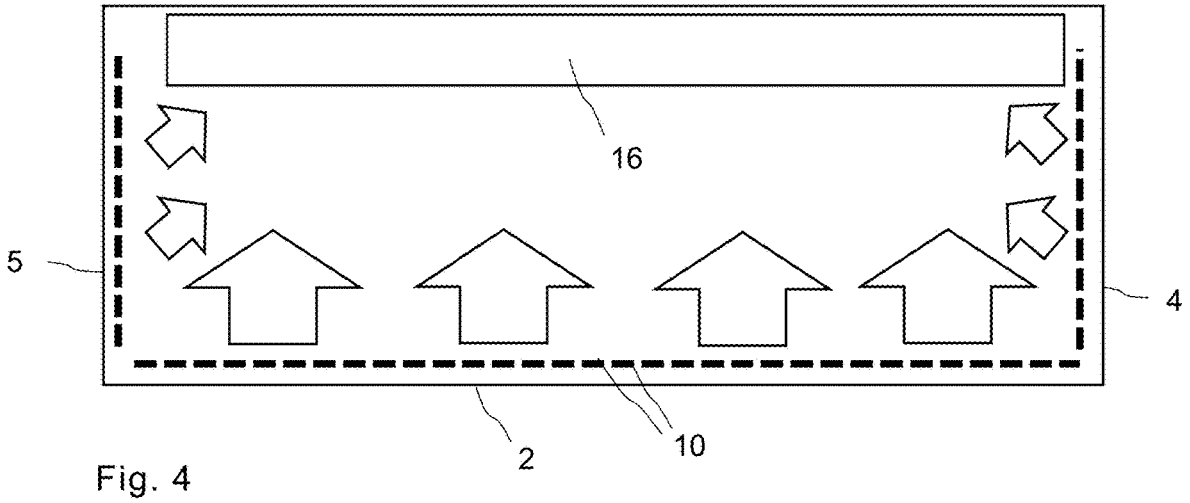
FIG. 4 shows a schematic view of the hood in a horizontal cut and the forced air flow from front and side walls of the hood.

The air streams created by the forced fresh air are shown schematically in FIG. 4. Air inlet slots 10 are formed at the lower edge of the hood along front and side walls 2, 4, 5. The air forced through these slots creates a continuous, flat stream of air around the entire perimeter of the hood 1, which directs smoke and other byproducts into grease filters 16.

Figure 5:
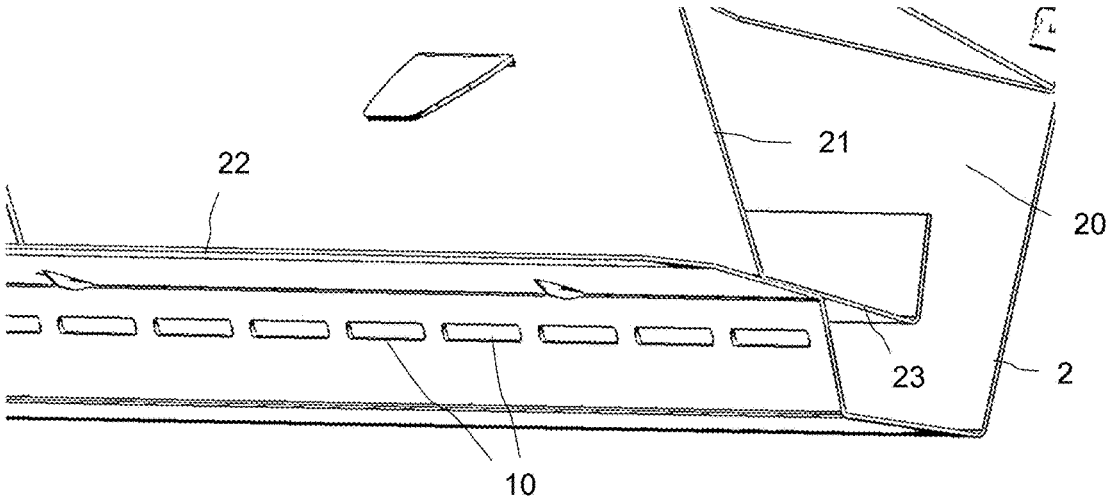
FIG. 5 shows a detail view of the bottom edge of the front wall of the hood with the side wall removed.
Figure 6:
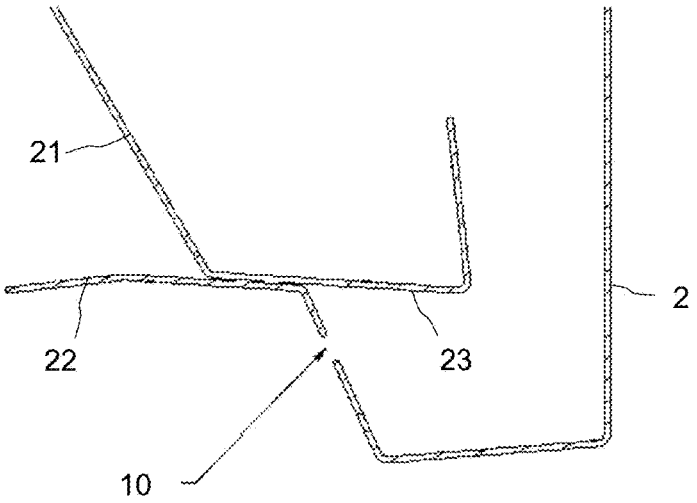
FIG. 6 shows a cross section of the bottom edge of the front wall.

In FIG. 5, the edge of the front wall 2 is shown in more detail. Inner and outer metal sheets are bend and connected to form a front side air duct 20 for the injection of fresh air. The rectangular or slightly oval inlet slots 10 have dimensions of 4.5×80 mm at a spacing of 5 mm. Above the inlet slots 10 is a baffle sheet or flange. A second baffle sheet 23 extends horizontally inside the air duct 20, while the free end of baffle sheet 23 is angled upwardly inside the duct 20 so that it runs parallel to the front wall 2. The free end of baffle sheet 22 is angled slightly downwards by a flat angle of approximately 10 degrees. The baffle sheets 22, 23 contribute to form and flatten the forced air stream.

Figure 7:
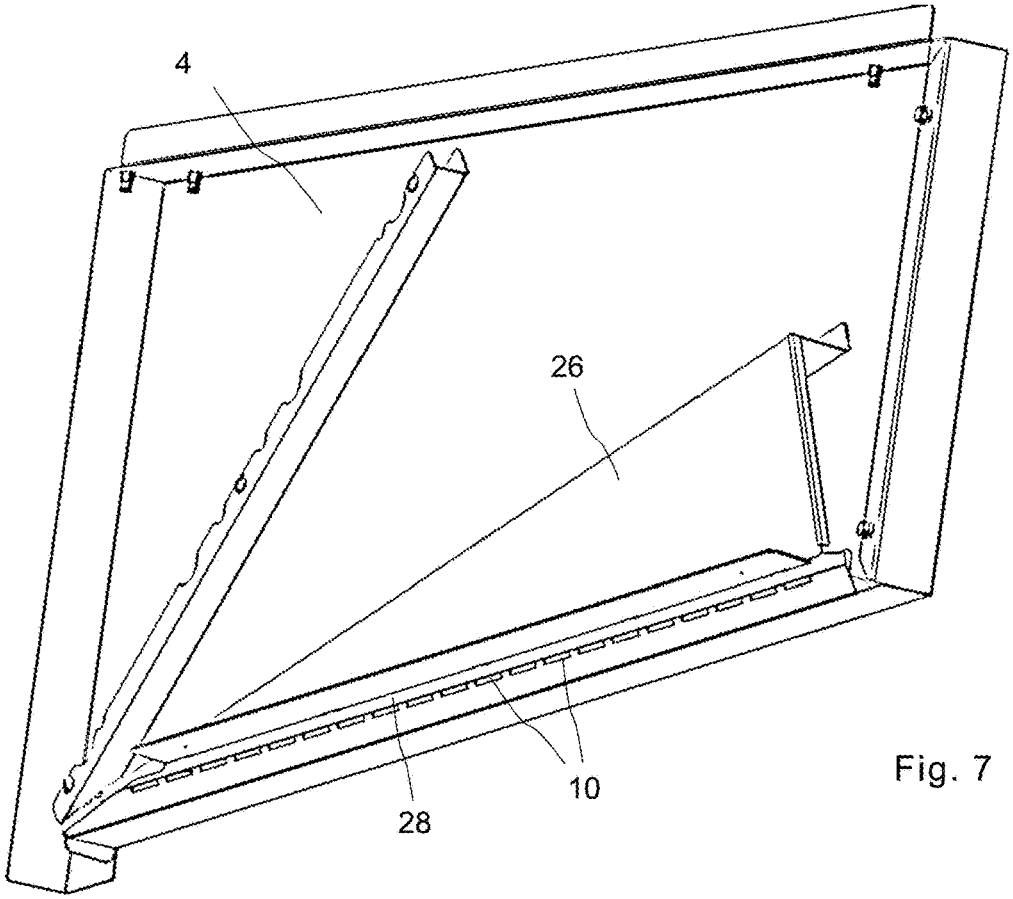
FIG. 7 shows a view of the side wall from its inwardly facing side.
Figure 8:
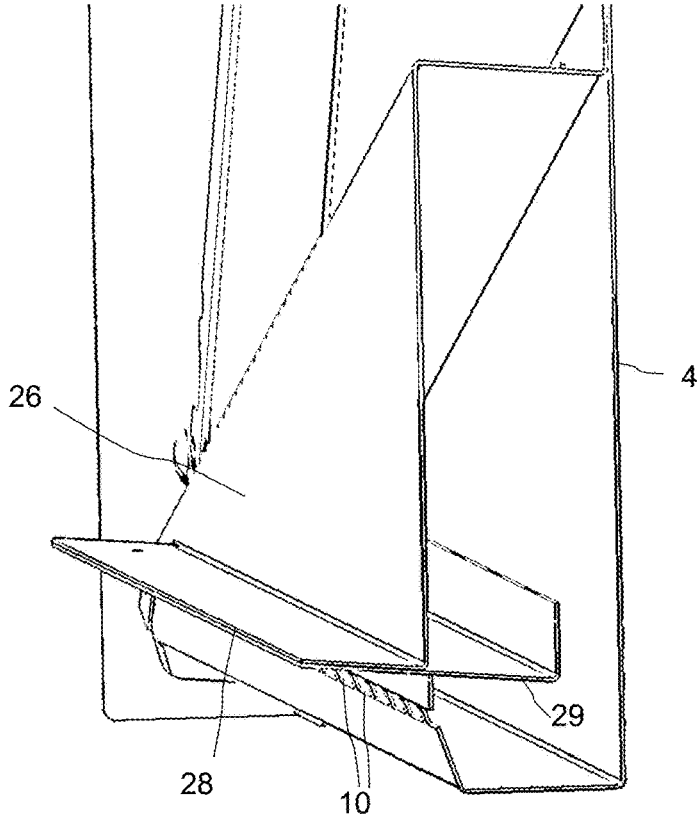
FIG. 8 shows a detail view of the side wall with the air duct facing the front wall.

A side wall 4 of the hood 1 is shown in FIGS. 7 and 8 in more detail. The side wall 4 carries at its inner side an air duct 28, which at its lower edge has air slots 10 for forced air injection. The air duct 28 is triangular in shape tapering from the front wall towards the rear wall. At its front side, the air duct 26 is open and communicates with air duct 20 of the front wall 2 so that air from the fresh air fan 18 also reaches the air inlet slots 10 at the side walls 4, 5. Similar to the front wall air duct 20, a baffle sheet 28 extends in horizontal direction from above the air slots 10 into the hood and an upwardly angled second baffle sheet extends in opposite direction into the air duct 26.

The air flow volume of air forced by fresh air fan 18 through the slots 10 is approximately 20 cubic feet per minute, per linear foot of the hood 1. This amounts to approximately 10% of the exhaust air rate moved by the exhaust fan of the hood 1 through exhaust vents 6. The exhaust hood of the embodiment with two hood segments a, 1*b* is operated with two exhaust fans which have an exhaust airflow volume that will vary with the length of the hood.

To summarize, the exhaust hood 1 uses a fresh air fan 18 to pull fresh air from the ceiling space above the hood. The air is then distributed around the perimeter of the hood 1, through rectangular slots 10, in a vertical air stream which pushes rising smoke from the cooking appliances 12 below into the hood filters 16.

It should be noted that in the present embodiments, the exhaust hood is shown with its exhaust vent 6 and grease filters oriented towards the backside of the hood such as towards a wall of the kitchen. It should be understood that such a kitchen hood can also be installed the opposite way, i.e. with its vent and filters oriented to the front side of the kitchen. The terms front side and rear side of the exhaust hood are therefore used interchangeably and without limitation to the way the exhaust hood can and will be installed in a kitchen.

Figure 9:
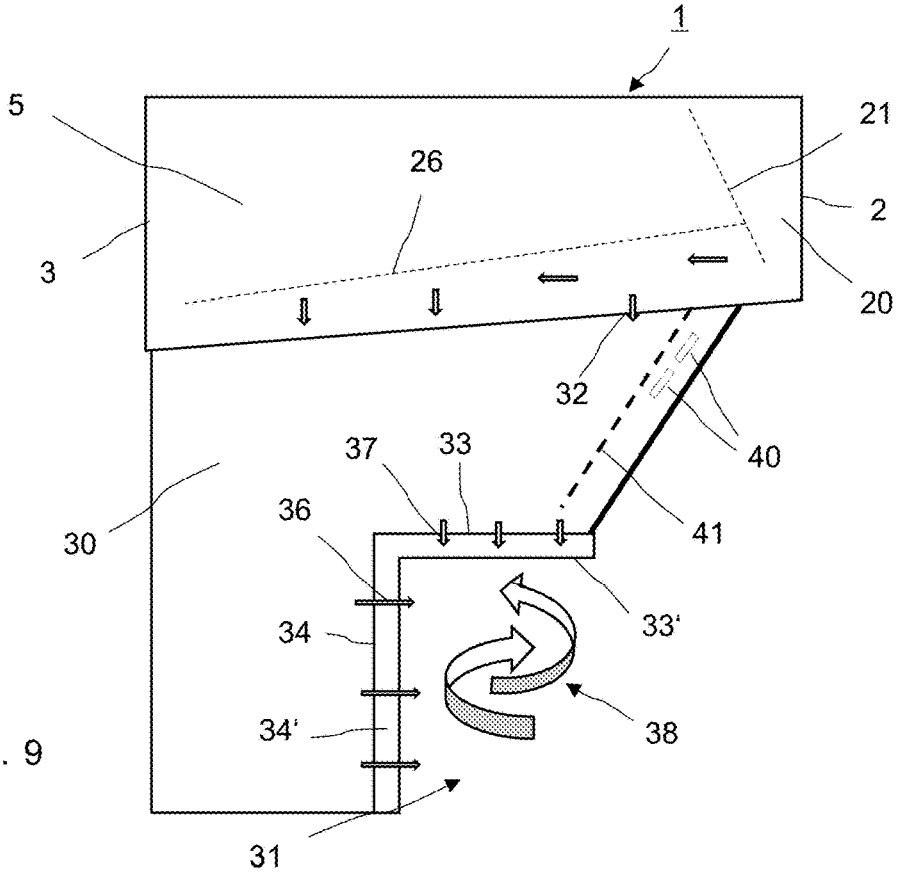
FIG. 9 shows in a side view a further embodiment of an exhaust hood with additional skirt.
Figure 10:
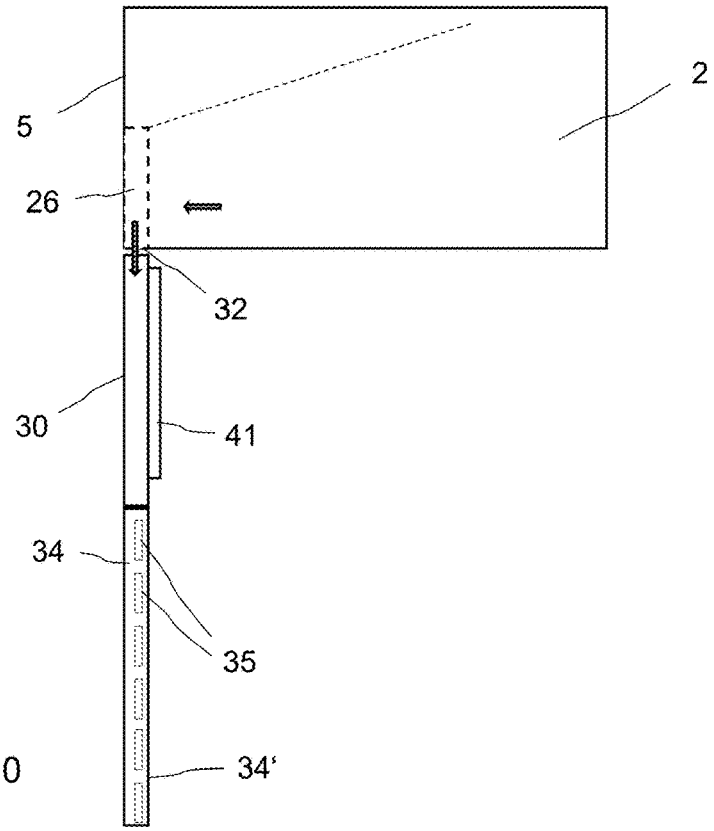
FIG. 10 shows a front view (left side only) of the exhaust hood shown in FIG. 9.

A further embodiment of a kitchen hood is depicted in FIGS. 9 and 10. The hood, which is of similar design as the exhaust hood described above, has an additional side wall extension, which forms a skirt to prevent effluents of a kitchen appliance placed flush to the side of the exhaust hood from escaping.

In some instances, when the appliance on the end does not require interaction with equipment outside the hood, a single layer, angled hanging skirt can be added to hold the smoke and effluent inside the confines of the hood. However, such a hanging skirt can be cumbersome for the kitchen personnel when the appliance on the end underneath the hood requires interaction with equipment outside the hood. In this case, the angled panel will interfere with the moving of product from underneath the hood to the appliance outside the hood.

For these reasons, the hood 1 in the third embodiment has a special skirt 30 with a pass-through window 31 at its lower end that serves as a passage way for the kitchen personnel to move a product from the appliance underneath the hood to another appliance outside the hood. The skirt 30 can either be attached to and hanging from either of the side walls 4, 5 of the hood 1 or can be integral with the side walls 4, 5. A special forced air ejection system is provided at the pass-through window 31 to hold the smoke inside the hood, i.e. prevent effluents from escaping through the open pass-through window 31.

The skirt 30 is double walled and defines a duct, which is connected via a connection port 32 at the bottom edge of the side wall 5 to the ducts 26 and 20 of the hood 1. Thus fresh air from fan 18 can pass through the port 32 into the hollow space of the double-walled skirt. Along the edges 33, 34 of the pass-through window 31 at its narrow side, the skirt has openings 35 similar in shape, size and spacing to the slots 10, through which air streams 36, 37 will be ejected. The air streams 36, 37 are directed vertically downwards and horizontally in a forward direction toward the front of the hood 1. As these air streams 36, 37 coalesce, they create a vortex 38 which prevents cooking byproducts from passing through the pass-through window. Together the rising effluents from a kitchen appliance positioned flush to the pass-through window, a rising turbulence, which can be described as a kind of "mini tornado" will be created.

Alternatively, instead of connecting the double-walled skirt with the ducts 26 and 20, a separate fan could be provided for the side wall skirt.

The coalescence of streams 36 and 37 and formation of air vortex 38 is further supported by baffle sheets 33' and 34' extending next to the openings 35 from the inner sheet wall of the skirt 30 into the pass-through window 31. Further air slots 40 at the inside of the skirt, i.e. facing inside the space confined by the hood, eject streams of fresh air which together with an inward-facing baffle sheet or flange 41 cause the "mini tornado" to rise into the housing of the hood and directly into the exhaust vents 6.

The invention claimed is:

1. An exhaust hood for removing cooking by-products from a kitchen environment, the exhaust hood comprising:

a housing open towards a bottom face to capture cooking by-products from a cooking appliance positioned below said exhaust hood;

said housing having at least a first wall, which is either a front wall or a rear wall, and a second wall opposite to said first wall;

said second wall being at least partly inclined inwardly from said bottom face towards a top face of said housing and having an exhaust vent in communication with an exhaust fan to extract cooking by-products entering said housing;

said first wall being shaped to form a first duct having a number of openings located in a row along a lower edge of said first wall adjacent to said bottom face and oriented toward an inside of said housing;

a fresh air fan in communication with said first duct, said fresh air fan being adapted to inject air streams through said openings into said housing in a direction substantially parallel to said bottom face thus creating a flat air stream directed from said first wall towards said second wall;

side walls that extend between the first wall and the second wall, the side walls at least partly shaped to form second ducts, each said second ducts having a number of openings located in a row along a lower edge of said side walls adjacent to said bottom face and oriented to the inside of said housing, said second ducts being in communication with said first duct to inject air streams through said openings into said housing in a direction substantially parallel to said bottom face, and a downwardly oriented connection port in one of the side walls;

a side wall extension extending from the one of the side walls in a direction perpendicular to said bottom face below said housing to form a lateral skirt, said skirt having towards a bottom end thereof a pass-through window defined by vertically and horizontally extending faces, said side wall extension being shaped to form a side wall duct with openings along the vertically and horizontally extending faces adjacent to said pass-through window; and said side wall duct is in communication with said downwardly oriented connection port to eject vertical and horizontal air streams orthogonal to one another through said openings, which coalesce to form a vortex which prevents cooking by-products from passing through the pass-through window.

2. The exhaust hood according to claim 1, wherein the skirt is integral with the one of the side walls.

3. The exhaust hood according to claim 1, further comprising baffle sheets that extend next to the openings along the vertically and horizontally extending faces from an inner sheet wall of the skirt into the pass-through window.

4. The exhaust hood according to claim 1, further comprising air slots located above pass-through window at an inside of the skirt facing toward a space confined by the hood, said air slots are adapted to eject streams of fresh air.

5. The exhaust hood according to claim 4, further comprising an inward-facing baffle sheet or flange adjacent to the air slots.

6. The exhaust hood according to claim 1, wherein said first wall comprises an inner and an outer sheet being connected to enclose a cavity with substantially trapezoidal cross section serving as said first duct, said inner sheet being at least partly inclined inwardly from said bottom face towards a top face of said housing.

7. The exhaust hood according to claim 1, wherein an air volume of said injected air streams corresponds to about 5% to 25% of an air volume extracted through said exhaust vent by said exhaust fan.

8. The exhaust hood according to claim 1, wherein said second ducts have a substantially triangular shape decreasing in cross section from the first wall towards the second wall.

9. An exhaust hood for removing cooking by-products from a kitchen environment, the exhaust hood comprising:

a housing open towards a bottom face to capture cooking by-products from a cooking appliance positioned below said exhaust hood, said housing having at least a first wall, which is either a front wall or a rear wall, and a second wall opposite to said first wall, said second wall being at least partly inclined inwardly from said bottom face towards a top face of said housing and having an exhaust vent in communication with an exhaust fan to extract cooking by-products entering said housing, a side wall and side wall extension, said side wall extension extending in a direction perpendicular to said bottom face below said housing to form a lateral skirt, said skirt having towards a bottom end thereof a pass-through window defined by vertically and horizontally extending faces, said side wall extension being shaped to form a side wall duct with openings along the vertically and horizontally extending faces adjacent to said pass-through window; and a fresh air fan in communication with said side wall duct, said fresh air fan being to adapted to eject vertical and horizontal air streams orthogonal to one another through said openings, which coalesce to form a vortex which prevents cooking by-products from passing through the pass-through window.

10. The exhaust hood according to claim 9, further comprising baffle sheets that extend next to the openings along the vertically and horizontally extending faces from an inner sheet wall of the skirt into the pass-through window.

11. The exhaust hood according to claim 9, wherein said side wall duct comprises further inwardly facing air slots to eject air streams in a direction towards an inside of said housing.

12. The exhaust hood according to claim 11, further comprising an inward-facing baffle sheet or flange adjacent to the air slots.

* * * * *